US007946634B2

(12) United States Patent
Bendel

(10) Patent No.: US 7,946,634 B2
(45) Date of Patent: May 24, 2011

(54) VEHICLE DOOR LATCH

(75) Inventor: Thorsten Bendel, Oberhausen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 0 days.

(21) Appl. No.: 10/563,949

(22) PCT Filed: Jun. 26, 2004

(86) PCT No.: PCT/DE2004/001353

§ 371 (c)(1),
(2), (4) Date: May 11, 2006

(87) PCT Pub. No.: WO2005/005757

PCT Pub. Date: Jan. 20, 2005

(65) Prior Publication Data

US 2007/0079640 A1 Apr. 12, 2007

(30) Foreign Application Priority Data

Jul. 9, 2003 (DE) ..... 103 31 080

(51) Int. Cl.
*E05C 3/06* (2006.01)
*E05C 3/16* (2006.01)

(52) U.S. Cl. ..... 292/201; 292/216; 292/DIG. 23

(58) Field of Classification Search ..... 292/201, 292/216, DIG. 23
See application file for complete search history.

(56) References Cited

U.S. PATENT DOCUMENTS 5,020,838 A * 6/1991 Fukumoto ..... 292/201
5,802,894 A * 9/1998 Jahrsetz et al. ..... 70/264
5,934,717 A * 8/1999 Wirths et al. ..... 292/201
5,938,253 A * 8/1999 Szablewski et al. ..... 292/216
6,076,868 A * 6/2000 Roger et al. ..... 292/201
6,155,124 A * 12/2000 Wirths ..... 74/89.13
6,371,536 B1 * 4/2002 Koerwer et al. ..... 292/201
6,386,599 B1 * 5/2002 Chevalier ..... 292/201
6,390,517 B1 * 5/2002 Ehret ..... 292/201

(Continued)

FOREIGN PATENT DOCUMENTS

EP 1 085 148 B1 3/2001
JP H09-287337 11/1997
WO WO 03/018939 A1 3/2003
WO WO 03018939 A1 * 3/2003

OTHER PUBLICATIONS

Computer Generated Preliminary Translation of WO 3018939 A1, http://gb.espacenet.com/search97cgi/s97_cgi.exe?Action=FormGen&Template=gb/EN/home.hts.*

Official Translation of Nass et al. WO 03/018939.*

Japan Patent Office, Office Action, Japanese Patent Application No. 2006-517949, dated Feb. 2, 2010, 3 pages.

*Primary Examiner* — Carlos Lugo
*Assistant Examiner* — Alyson M Merlino
(74) *Attorney, Agent, or Firm* — Konomi Takeshita

(57) ABSTRACT

The object of the present invention is a vehicle door latch, whose basic version contains a locking mechanism (1, 2) with at least one operating lever (3) for the locking mechanism (1, 2) and a motor drive (4, 5, 6, 7) for opening the locking mechanism (1, 2). According to the invention, the motor drive (4, 5, 6, 7) directly acts upon the locking mechanism (1, 2) solely via the operating lever (3).

12 Claims, 5 Drawing Sheets

U.S. PATENT DOCUMENTS 6,400,278 B1 * 6/2002 Weyerstall et al. ..... 340/686.3
6,428,058 B1 * 8/2002 Graute ..... 292/216
6,435,573 B1 * 8/2002 Szablewski ..... 292/201
6,439,623 B1 * 8/2002 Lohfeld et al. ..... 292/201
6,471,259 B1 * 10/2002 Weyerstall et al. ..... 292/201
6,575,507 B2 * 6/2003 Reddmann ..... 292/216
6,648,380 B1 * 11/2003 Szablewski et al. ..... 292/201
6,705,649 B1 * 3/2004 Reddmann ..... 292/216
2001/0052705 A1 * 12/2001 Fisher ..... 292/216
2004/0174021 A1 * 9/2004 Tensing et al. ..... 292/216

* cited by examiner

VEHICLE DOOR LATCH

CROSS REFERENCE TO RELATED APPLICATIONS

This application claims priority under 35 U.S.C. 119 based upon German Patent Application No. 103 31 080.0, filed Jul. 9, 2003. The entire disclosure of the aforesaid application is incorporated herein by reference.

BACKGROUND OF THE INVENTION

The invention refers to a vehicle door latch with a locking mechanism, at least one operating lever for the locking mechanism and a motor drive for opening the locking mechanism. As usual, the locking mechanism mainly consists of a catch and a pawl.

Such vehicle door latches are adequately known and are used where such a latch is to be opened electrically. As such a motor drive generally contains an electric motor. The described electric opening is, for instance but not exclusively, initiated by a so-called "keyless entry" or "keyless go" operation. In this case, an upstream wireless authorization check is carried out on an operator seeking to gain access, which after a positive check actuates the motor drive for opening the locking mechanism, so that immediately afterwards, a vehicle door can be opened and/or released. This may also be motor-driven or manual process.

At the same time, it is also possible to operate an internal door handle or external door handle, with this action being detectable by a switch assigned to the respective handle. Depending on the functional position of the vehicle door latch (e.g. unlocked, locked or double locked), the obtained switching signal is converted into a respective execution signal for the motor drive.

Generally, the motor drive in question only arranges the opening of the respective locking mechanism. This means that, the mechanism must first be moved to the unlocked state if it is not already in this state. Generally, the motor drive can also be used for first unlocking the vehicle door latch and then opening the locking mechanism.

Prior art has already disclosed successful attempts of developing a vehicle door latch in such a way that its opening is guaranteed in any event. The generic WO 03/018939 A1 suggests, for instance that the motor drive acts indirectly on the operating lever or actuating lever via an intermediate energy-saving device.

A solution according to also a generic EP 1 091 061 A2 contains an already more complex mechanical system. In this system, the drive disc of the motor drive contains a driving pin, arranged with a stop on a blocking lever, arranged separately from the pawl of the locking mechanism. This blocking lever is moved along by the pawl, during its displacement, into a position releasing the catch, its blocking position. This is mechanically more complex and more expensive.

A similar system is shown in the generic door latch of EP 1 085 148 A2. In this case, too, a blocking lever is provided in addition to the opening lever with both being arranged to rotate around a common axis.—The invention aims to provide a solution for this problem.

SUMMARY OF THE INVENTION

The invention aims to solve the technical problem of providing a functional, simple and cost-effective solution for a generic vehicle door latch for motorized opening.

In order to solve this technical problem, a generic vehicle door latch according to the invention is characterized in that the motor drive directly actuates the locking mechanism and, in particular, the pawl via solely the operating lever. The motor drive may be a reversing drive and preferably contains a drive disk with front-sided cams and a rear-sided element limiting the rotation angle.

In contrast to the prior art of the two European patents EP 1 091 061 A2 and EP 1 085 148 A2 the invention expressly does not require additional levers, springs, etc. Instead it has been found to suffice for a reliable operation, if the motor drive only operates the operating lever, which in turn actuates the locking mechanism and in this case preferably the pawl. As the suggested solution uses a minimum of required components, manufacturing costs can be kept particularly low, without any danger of malfunctioning.

Generally, the element limiting the angle of rotation cooperates with a stationary stop. This stationary stop may be fixed to the frame box, latch housing, etc. Together with the element limiting the angle of rotation, the stop ensures that the rotation movements of the motor drives and thus of the drive disk, are limited in the actuation and reverse direction. The stop actually provides two stop surfaces, on one hand, for the element limiting the angle of rotation moving in the actuating direction and, on the other hand, for the element limiting the angle of rotation, moving in the reverse direction.

In most cases, the operating lever contains two arms with an operating and an actuating arm. In most cases, the operating arm is acted upon by the drive, whilst the actuating arm acts on the locking mechanism and, in this case in particular, the pawl. In addition, the operating lever may also contain a third arm, the opening arm, on which a mechanical opening device can act upon. This third arm of the operating lever thus ensures that if, for instance, the motor drive has failed, the locking mechanism can still be mechanically opened. A closing cylinder with a cam could, for instance, act upon this third arm.

From a procedural point of view, the motor drive generally acts upon the drive disk in actuation direction for opening the locking mechanism until the element limiting the angle of rotation, lies against the stop in an opening position. As already described, the stop contains two stop surfaces, an actuating and a reversing surface. In the opening position, the element limiting the angle of rotation, lies against the actuating surface of the stop.

The opening position is then maintained, until the locking mechanism has been reliably opened. It is, for instance, possible to detect this locking mechanism opening using a sensor on e.g. the catch—a catch switch or similar. Once the fully opened catch actuates the respective catch switch, the control unit detects that the locking mechanism is open and that the opening position can be released (again). Whilst the motor drive acts upon the drive disk and/or the operating lever in its actuating direction for opening the locking mechanism and also in the opening position, the operating lever generally ensures that the pawl is lifted off the catch so that the catch can be opened with the aid of a spring. Only once the locking mechanism has been reliably opened, does the control unit send out the reversing command to the motor drive.

After opening the locking mechanism, the motor drive acts upon the operating lever in its reverse direction until the pawl, previously held by the operating lever, is released. As the catch is open in this situation, the released pawl lies against the catch and can, during the subsequent (manual) closing operation of the vehicle door easily engage with the catch, if the latter is moved into the locking position by a locking bolt during this process.

The opening position of the operating lever, described above and thus also the drive disk, can be set and maintained without requiring considerable force from the motor drive. This is due to the fact that the operating lever contains a spring against which the motor drive has to act when opening the locking mechanism. According to the invention, this counterforce generated by the spring, is applied radially in direction onto a rotational axis of the drive disc and, preferably, through the cam.

Because of this design, the motor drive could, strictly speaking, even be switched off in the opening position and its self-locking forces would suffice, as the counterforce of the spring only acts radially in direction of the axis of rotation of the drive disk onto the cam and no lateral forces are applied. As there are no lateral forces, the cam is neither turned in one nor the other direction by the spring on the operating lever in the opening position. Rotations in actuating direction are blocked anyway, as the element limiting the angle of rotation lies against the actuating surface of the stop.

BRIEF DESCRIPTION OF THE DRAWINGS

FIGS. 1 to 4 show the vehicle door latch of the invention in various functional positions, from the front and rear and, in which

DETAILED DESCRIPTION OF THE INVENTION

Figure 3:
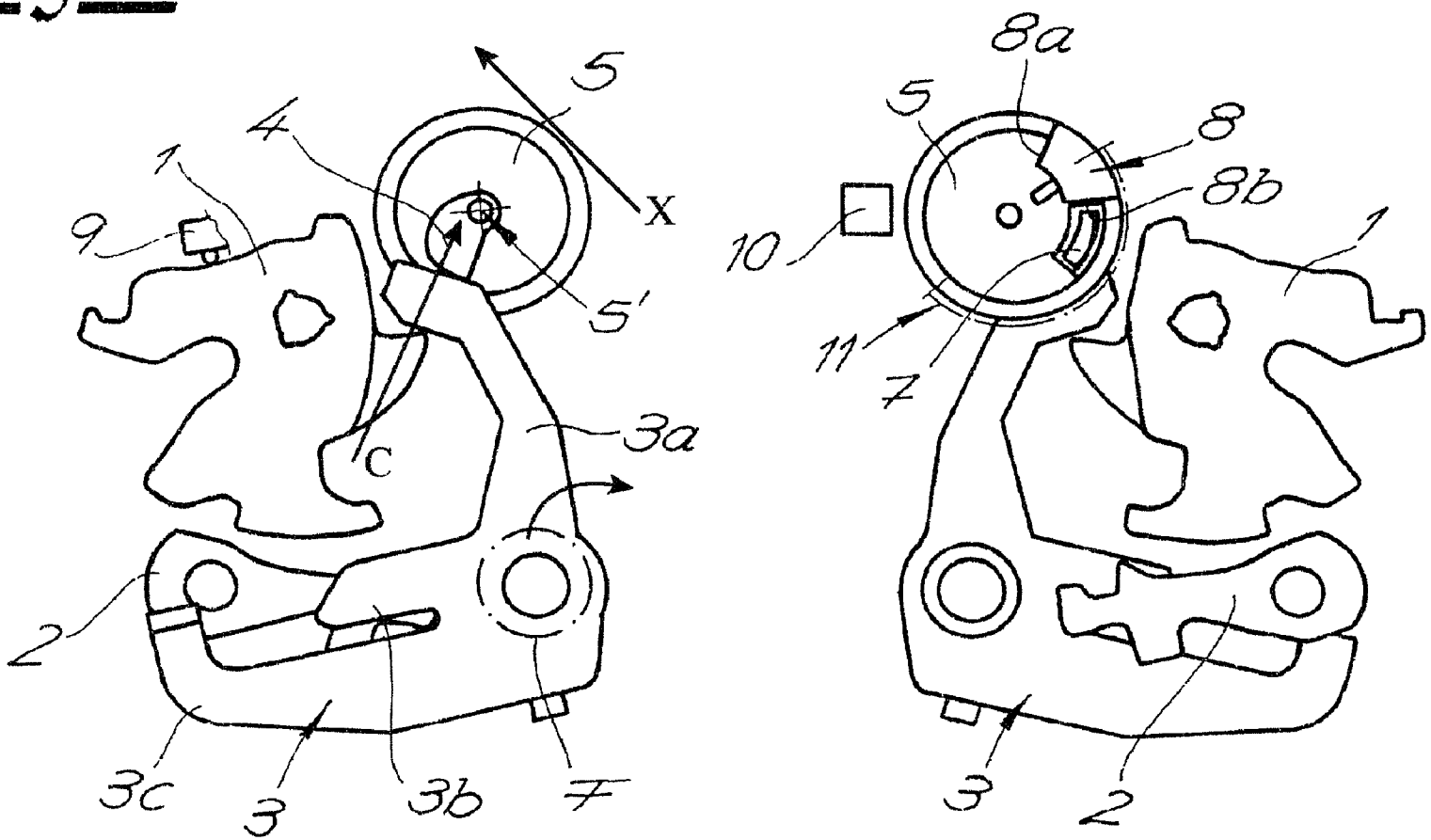
Figure 4:
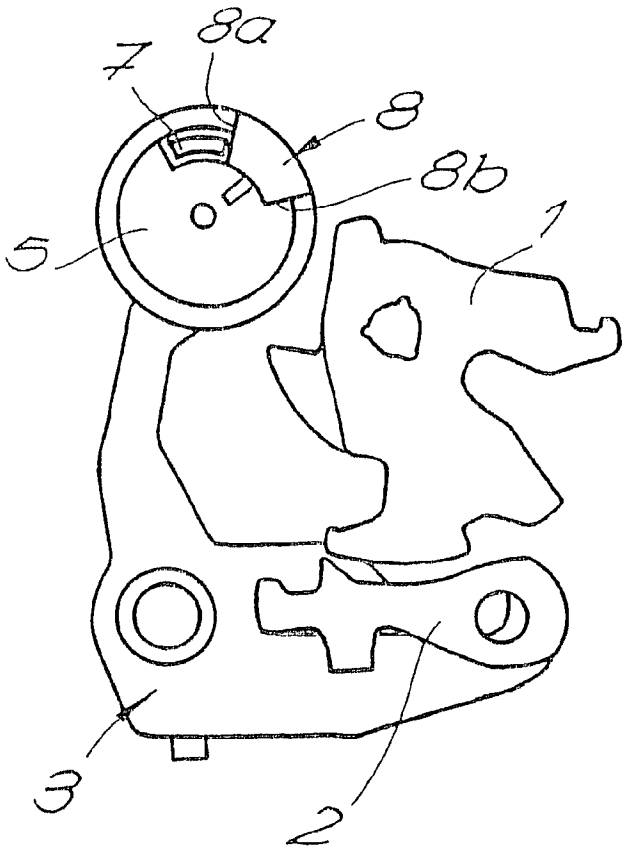
Figure 4:
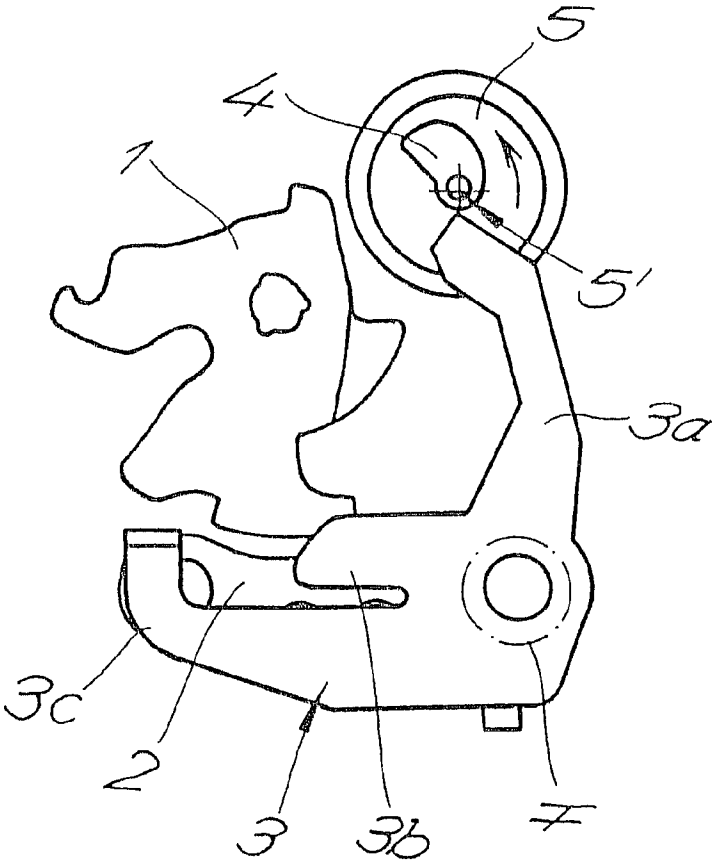
Figure 5:
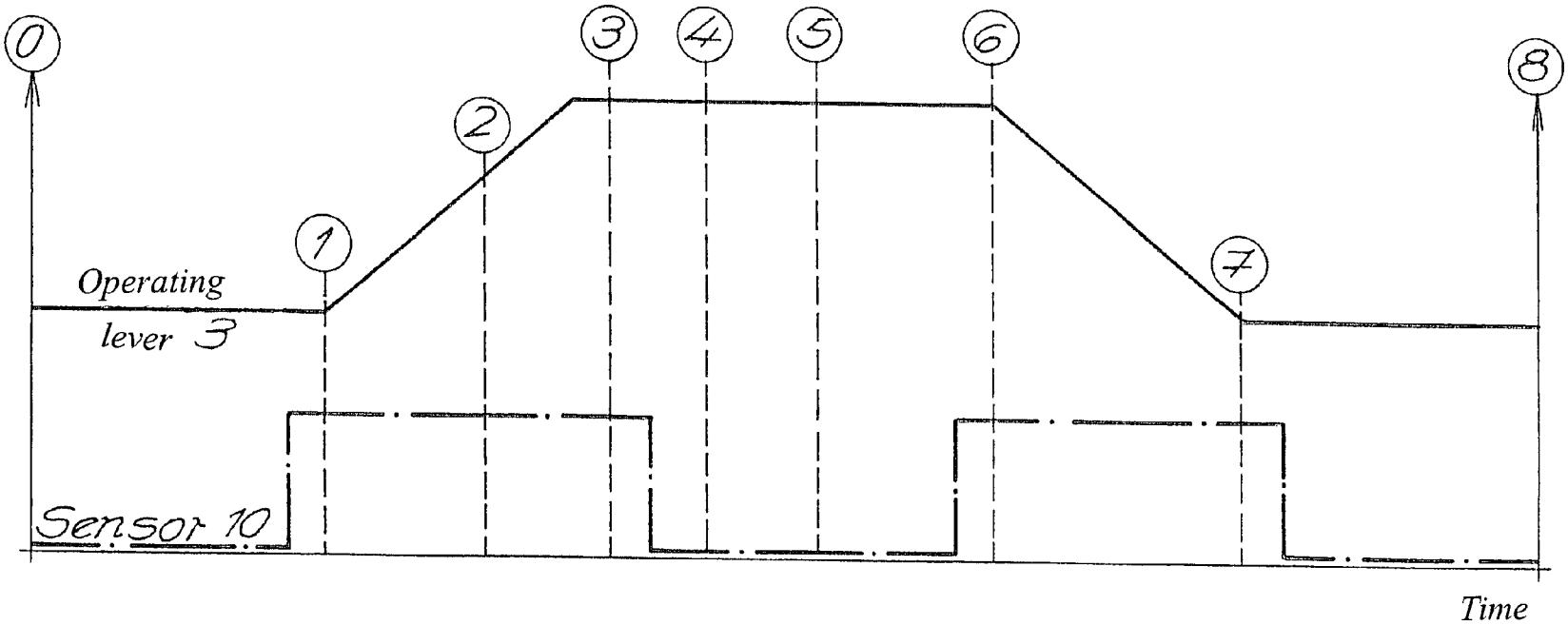
FIG. 5 shows a schematic functional flow diagram over time.

Below, the invention is explained in more detail with reference to a drawing showing only one embodiment, in which:

FIGS. 1 to 4 show the vehicle door latch of the invention in various functional positions, from the front and rear and, in which FIG. 5 shows a schematic functional flow diagram over time.

The figures show a vehicle door latch containing, as usual, a locking mechanism 1, 2 comprising a catch 1 and pawl 2. The figures also show an operating lever 3 for the locking mechanism 1, 2 and a motor drive 4, 5, 6, 7 for opening the locking mechanism 1, 2. The motor drive 4, 5, 6, 7 actually comprises an electric motor 6, a drive disk 5, a cam or actuating cam 4 arranged on the drive disk 5 and an element limiting the angle of rotation 7. The electric motor 6 is able to move the drive disk 5 in clockwise and counterclockwise direction and thus operates—like the entire motor drive 4, 5, 6, 7—reversibly. This is indicated by the double arrow in FIG. 1.

It is apparent that the motor drive 4, 5, 6, 7 directly acts upon the locking mechanism 1, 2 via solely the operating lever 3. For this purpose, the operating lever 3 contains a total of three arms, an operating arm 3*a*, an actuating arm 3*b* and an opening arm 3*c*. The opening arm 3*c* ensures that the locking mechanism 1, 2 can also be opened if the motor drive 4, 5, 6, 7 has failed, e.g. mechanically via a closing cylinder or a similar not expressly shown opening device. This is, however, not mandatory and opening arm 3*c* is simply an option for the invention.

Significant for the motorized opening as part of the invention is, however, the operating arm 3*a*, acted upon by drive 4, 5, 6, 7 or, more accurately, by cam 4. Also the actuation arm 3*b*, acting upon the locking mechanism 1, 2 or, more accurately, pawl 2.

The rear views show that the drive disk 5 contains the element limiting the angle of rotation 7 on its back. This element limiting the angle of rotation 7 co-operates with a stationary stop 8 that can be fixed to latch housing 13. The stationary stop 8 contains two stop surfaces 8*a*, 8*b*, an actuating surface 8*b* and a reversing surface 8*a*.

Figure 1:
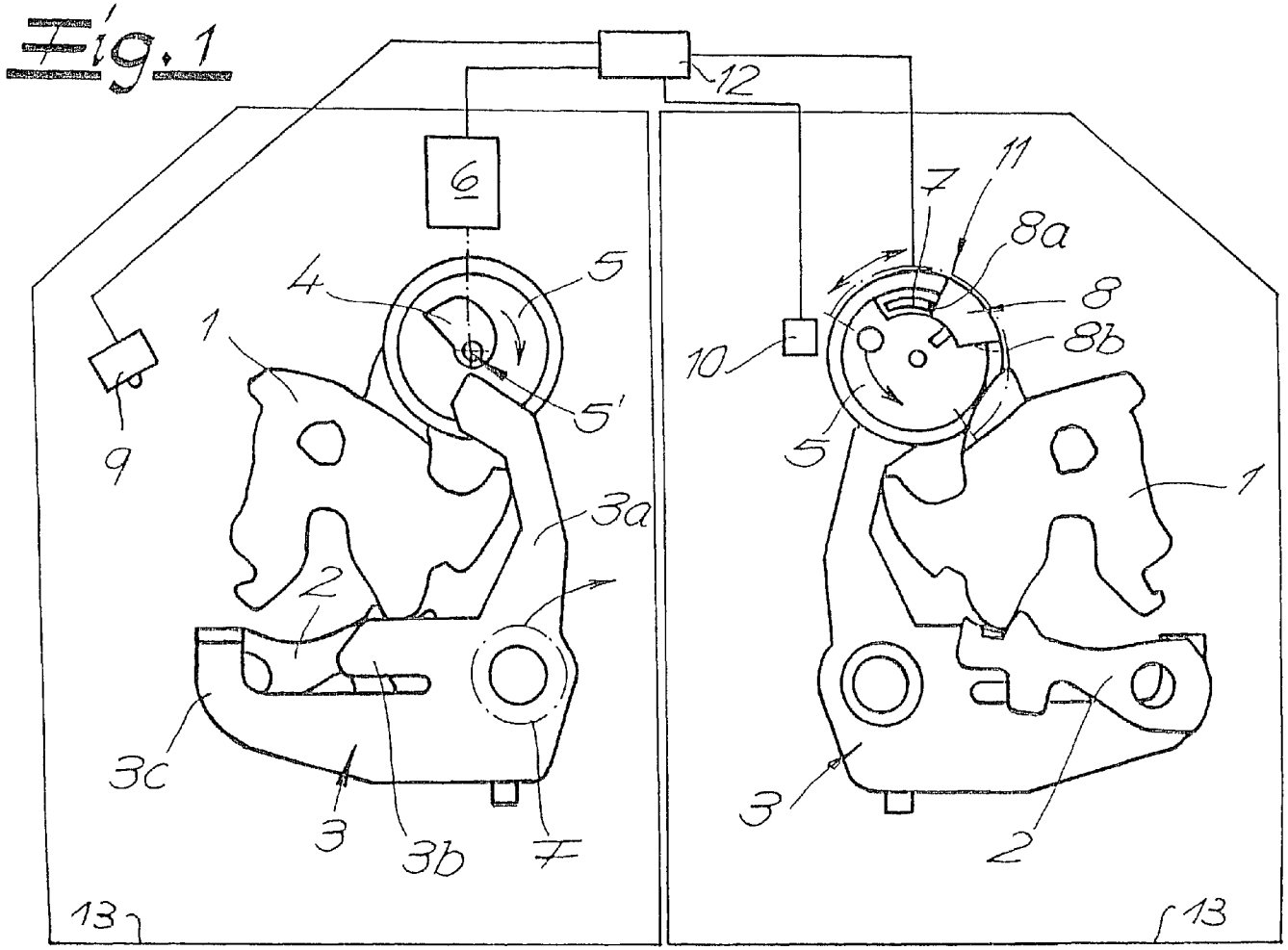
Figure 2:
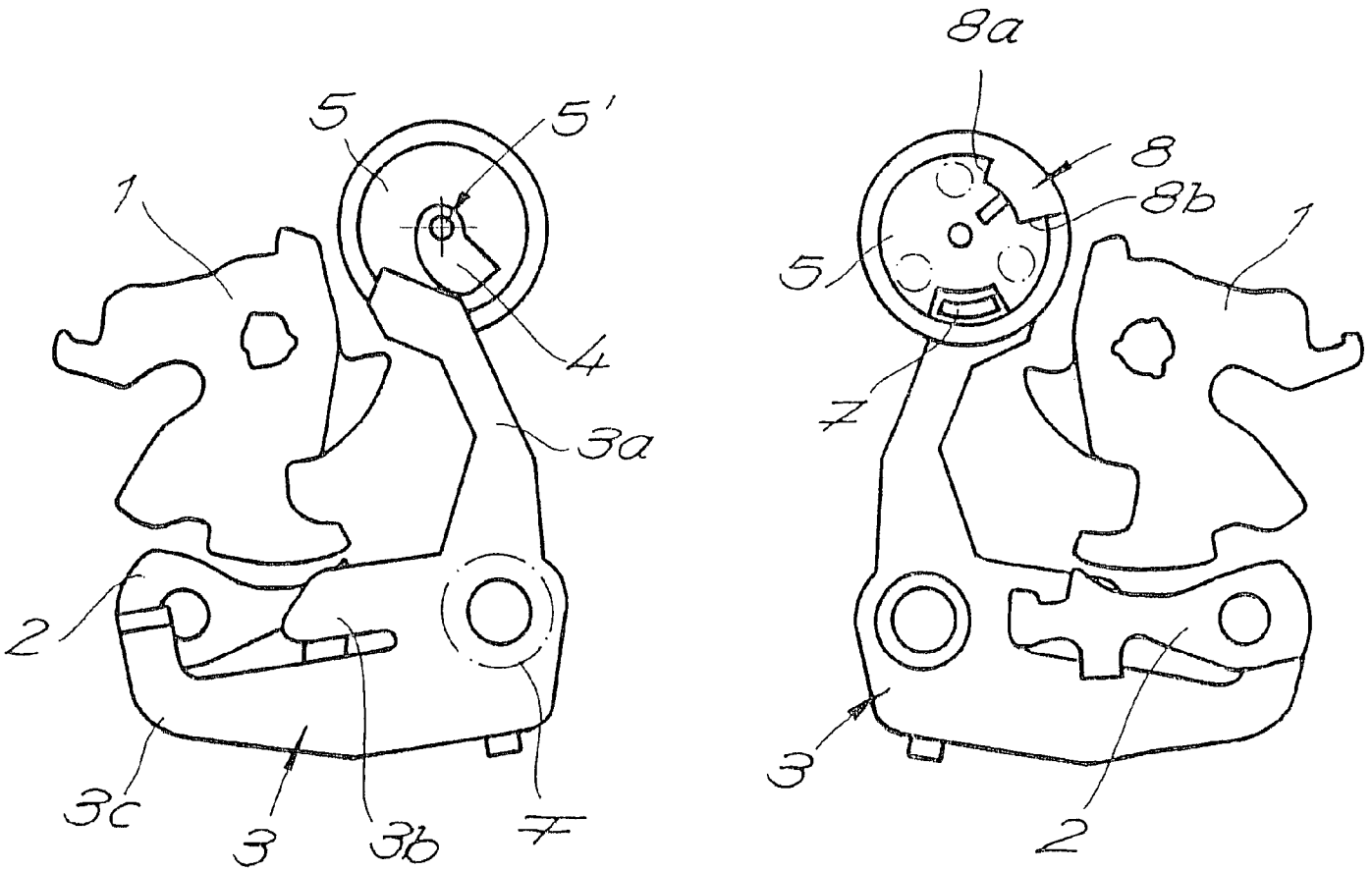

Also, two further functional elements are provided, in form of a spring F—only indicated—acting upon the operating lever 3 in the direction shown in FIG. 1. This means that the operating lever 3 is acted upon by spring F in clockwise direction around its axis in the respective front view. In addition, there are individual sensors 9, 10, 11, to signal, on one hand, the position of catch 1 and, on the other hand, the position of the drive disk 5 and of the motor drive 4, 5, 6, 7 to a control unit 12. Depending on the functional position of the vehicle door latch, the control unit 12 passes on respective commands to the electric motor 6 for its actuation.

The system functions as follows. Starting from a position as shown in FIG. 1 with a closed locking mechanism 1, 2, i.e. with pawl 2 engaged in the primary position of catch 1, the motor drive 4, 5, 6, 7 is acted upon in such a way for opening the locking mechanism 1, 2 that the drive disk 5 in the front view of FIG. 1 carries out the indicated clockwise movement around its axis 5'. This corresponds to a counterclockwise movement in the rear view in the right part of FIG. 1.

After a certain displacement travel, a sensor surface 11 reaches the sensor or switch 10, so that it transmits a first signal to the control unit 12, as indicated by the rising edge in the bottom part of FIG. 5. Cam 4 then makes contact with the operating arm 3*a* of the operating lever 3.

The motor drive 4, 5, 6, 7 acts upon the operating lever 3 in its activation direction for opening the locking mechanisms 1, 2 (clockwise movement of drive disk 5 in front view in FIG. 1) until the element limiting the angle of rotation 7 lies against the stop 8 or, more accurately, against its actuating surface 8*b*. This status becomes clear in the transition from FIG. 1 to FIG. 2 and on to FIG. 3. Before, however, this so-called opening position acc. to FIG. 3 has been reached, the sensor surface 11 has ensured that the sensor or the switch 10 has received a switch-off impulse according to a second signal. At the same time, the falling edge of the first square-wave pulse in the bottom diagram of FIG. 5 has been reached.

The opening position acc. to FIG. 3 now corresponds in such a way that the pawl 2 has been fully lifted off the catch 1, allowing the catch 1 to turn to its open position with the aid of a spring. The opening position acc. to FIG. 3 is maintained until the catch 1 has reliably reached its opening position. This consequently also applies for the entire locking mechanism 1, 2. This status is detected by the sensor or the micro switch 9, which is a catch switch.

Due to the reliable opening of the locking mechanism 1, 2 the control unit 12 now ensures that the motor drive 4, 5, 6, 7 is acted upon in reverse direction. When comparing FIGS. 3 and 4, the reverse direction corresponds so that the cam 4 and the drive disk 5 on which it is arranged, carry out a counterclockwise movement when seen from the front view. As a result, the cam 4 moves away from the operating arm 3*a* of the operating lever 3. The motor drive 4, 5, 6, 7 is acted upon in reversing direction until the pawl 2, previously held by the operating lever 3, is released.

At the start of the reversing process, the sensor or the switch 10 register a switch-on process again, caused by the sensor surface 11, gliding past it. This process corresponds with the rising edge of the second square-wave pulse in the bottom diagram of FIG. 5. Upon release of the pawl 2, the element limiting the angle of rotation 7 reaches the reversing surface 8*a* of the stop 8, as shown in FIG. 4. Prior to this, the sensor area 11 generated a switch-off pulse at switch 10, corresponding with the falling edge of the second square-wave pulse.

It is apparent that, during the described process, the operating lever 3 carries out the movement shown in the top diagram of FIG. 5, with individual selected points and positions being specified. It is also significant that in the opening position in FIG. 3, the counterforce generated by spring F on the operating lever 3, runs radially in the direction, of axis 5' of the drive disk 5. This is indicated by an arrow C in the respective FIG. 3. The counterforce also runs through cam 4. The curved arrow at spring F shows the direction in which the spring operates on the operating lever 3, to produce this counterforce. In this way, the opening position as shown in FIG. 3 can be reached with a minimum of force, as there are no lateral forces X that could turn the drive disk 5 in one or another direction.

As already described, the top part of FIG. 5 shows the movement of the operating lever 3, whilst the bottom part shows the signals on the sensor 10. Individually exposed time points, labeled 1 to 7, are explained below.

From the start to time point 1, the electric motor 6 starts or accelerates until there is contact between the cam 4 and the operating lever 3 at time point 1. This is followed by an operating stroke up to time point 2, when catch 1 has mainly been released. The operating lever 3 is moved on—by a certain safety angle—until position 3 has been reached. The operating lever 3 is held in this position.

At time point 4, sensor 10 first of all detects the falling edge with the passing sensor surface 11, and the micro switch or catch switch 9 have registered that the catch 1 is open. The electric motor 6 now continues to run until the drive disk 5 with its element limiting the angle of rotation 7 rests against the actuating surface 8*b* of stop 8. This occurs at time point 5.

The blocking position of the electric motors 6 can be evaluated and serves as a signal for operating the electric motor 6 in reverse. This occurs starting at time point 5 to time point 6, with the electric motor 6 accelerating in reverse direction in this time period. Once the end of the sensor surface 11 has passed the sensor or switch 10 and thus the second rising edge has been registered by sensor 10, the release of the pawl 2 commences at time point 6. This release of the pawl 2 continues up to time point 7. Once the falling edge has been registered by the sensor 10, the electric motor 6 continues to run unchanged until the element limiting the angle of rotation 7 reaches the reversing surface 8*a* of the stop 8 in position 8. In this case, too, the blocking process can be evaluated in order to reverse the direction of movement of the electric motor 6 (again).

The invention claimed is:

1. A vehicle door latch comprising:

a locking mechanism;

an operating lever a motor drive containing a drive disk with a front-sided cam for causing a reciprocating motion of the operating lever, the cam having an irregular-shaped wheel portion and an end portion located about a cam rotational axis coincident with a drive disk rotational axis, a rear-sided element limiting the angle of rotation of the drive disk and an electric motor capable of turning in both an actuation direction and a reverse direction for directly driving a corresponding rotation of said drive disk in an actuation direction and in a reverse direction, said rotations being limited by the element limiting the angle of rotation, a control unit for controlling said turning of said electric motor, and a first sensor and a second sensor for signaling to said control unit a position of a catch of the locking mechanism and a position of the drive disk, respectively, for coordinating and timing said turning of the electric motor, said rotations of the drive disk and said resulting motions of the operating lever;

wherein the motor drive opens the locking mechanism by directly acting upon the locking mechanism solely via contact of the cam with the operating lever resulting from said driving of said drive disk in the actuation direction, wherein the operating lever pivotally engages a pawl of the locking mechanism to cause said pawl to release the catch and said rotation in the actuation direction continues until limited by the element limiting the angle of rotation, an opening position of the drive disk, wherein in said opening position of the drive disk, a counterforce generated by a spring on the operating lever, runs solely and radially through the irregular-shaped wheel portion of the cam in the direction of a rotation axis of the drive disk without providing a lateral force running in said actuation direction or in said reverse direction on the drive disk and said counterforce generated by the spring causes a frictional force on a generally flat surface of the cam to engage the operating lever to set and maintain the opening position of the drive disk regardless of any driving from said electric motor, wherein said opening position of the drive disk is maintained until the catch rotates to a fully open position, as signaled by said first sensor, and wherein the motor drive is then acted upon in reverse direction, based on said signaling from said first and said second sensors, until the pawl, held previously by the operating lever is released.

2. The vehicle door latch according to claim 1, wherein the element limiting the angle of rotation cooperates with a stationary stop fixed to a latch housing and limits the movements of rotation of the drive disk to the actuation and reverse directions.

3. The vehicle door latch according to claim 2, wherein the motor drive acts upon the operating lever in its actuating direction mechanism until the element limiting the angle of rotation rests against the stop in the opening position of the drive disk.

4. The vehicle door latch according to claim 1, wherein the operating lever contains at least two arms, an operating arm and an actuation arm.

5. The vehicle door latch according to claim 4, wherein the operating lever contains three arms, including an additional opening arm.

6. The vehicle door latch according to claim 4, wherein the operating arm is acted upon by the drive, whilst the actuation arm acts upon the locking mechanism.

7. A vehicle door latch comprising:

a locking mechanism having a catch and a pawl;

an operating lever;

a motor drive containing a drive disk with a front-sided cam for causing a reciprocating motion of the operating lever, the cam having an irregular-shaped wheel portion and an end portion located about a cam rotational axis coincident with a drive disk rotational axis, a rear-sided element limiting the angle of rotation of the drive disk and an electric motor capable of turning in both an actuation direction and a reverse direction for directly driving a corresponding rotation of said drive disk in an actuation direction and in a reverse direction, said rotations being limited by the element limiting the angle of rotation, a control unit for controlling said turning of said electric motor, and a first sensor and a second sensor for signaling to said control unit a position of a catch and a position of the drive disk, respectively, for coordinating and timing said turning of the electric motor, said rotations of the drive disk and said resulting motions of the operating lever;

wherein said control unit controls said electric motor to turn in the actuation direction, resulting in the corresponding rotation of said drive disk;

said motor drive directly acts upon the locking mechanism solely via contact of the cam with the operating lever resulting from said driving of said drive disk in the actuation direction;

a resulting reciprocating motion of said operating lever causes a pivotal engagement by said operating lever with said pawl, as signaled by said second sensor;

said pawl releases the catch and said rotation in the actuation direction continues until limited by the element limiting the angle of rotation, in an opening position of the drive disk, and said opening position of the drive disk is maintained until the catch rotates to a fully open position, as signaled by said first sensor;

wherein in said opening position of the drive disk, a counterforce generated by a spring on the operating lever, runs solely and radially through the irregular-shaped wheel portion of the cam in the direction of a rotation axis of the drive disk without providing a lateral force running in said actuation direction or in said reverse direction on the drive disk and said counterforce generated by the spring causes a frictional force on a generally flat surface of the cam to engage the operating lever to set and maintain the opening position of the drive disk regardless of any driving from said electric motor, said driving of said drive disk then continues in the actuation direction until stopped by a stationary stop cooperating with the element limiting the angle of rotation;

based on signaling from said second sensor and the stopping of the rotation, said control unit controls said electric motor to turn in the reverse direction;

a resulting further motion of the operating lever releases said pawl, as signaled by said second sensor; and said driving of said drive disk continues in the reverse direction until stopped by the stationery stop cooperating with the element limiting the angle of rotation and said operating lever is held in a pawl released position.

8. The vehicle door latch according to claim 7, wherein the element limiting the angle of rotation cooperates with the stationary stop, preferably fixed to a latch housing and limits the movements of rotation of the drive disk to the actuation and reverse directions.

9. The vehicle door latch according to claim 8, wherein the motor drive acts upon the operating lever in its actuating direction until the element limiting the angle of rotation rests against the stop in the opening position of the drive disk.

10. The vehicle door latch according to claim 7, wherein the operating lever contains at least two arms, an operating arm and an actuation arm.

11. The vehicle door latch according to claim 10, wherein the operating lever contains three arms, including an additional opening arm.

12. The vehicle door latch according to claim 10, wherein the operating arm is acted upon by the drive, whilst the actuation arm acts upon the locking mechanism.

* * * * *